United States Patent [19]

Ichihashi et al.

[11] Patent Number: 4,746,888

[45] Date of Patent: May 24, 1988

[54] SOLENOID FOR ELECTROMAGNETIC VALVE

[75] Inventors: Koji Ichihashi; Kyoji Tanaka; Wataru Takahashi, all of Higashimatsuyama, Japan

[73] Assignee: Diesel Kiki Co., Ltd., Tokyo, Japan

[21] Appl. No.: 71,259

[22] Filed: Jul. 8, 1987

[30] Foreign Application Priority Data

Jul. 18, 1986 [JP] Japan ..... 61-109256[U]

[51] Int. Cl.[4] ..... H01F 7/08

[52] U.S. Cl. ..... 335/262; 335/260

[58] Field of Search ..... 335/255, 257, 258, 260, 335/262

[56] References Cited

U.S. PATENT DOCUMENTS 4,166,262 8/1979 Jencks et al. ..... 335/262 X 4,233,585 11/1980 Sugimoto et al. ..... 335/262

FOREIGN PATENT DOCUMENTS 50-43523 4/1975 Japan ..... 335/255

*Primary Examiner*—George Harris

*Attorney, Agent, or Firm*—Wenderoth, Lind & Ponack

[57] ABSTRACT

A solenoid for an electromagnetic valve which has an exciting coil, a tubular hollow inner housing with a shaft sleeve portion thereof disposed within the coil, a tubular slide guide having a bottom made of a non-magnetic material which is contained within the housing, a stopper with a stationary shaft portion fitted in an opening end of the slide guide, and a plunger slidably contained within the slide guide which is defined by the end face of the shaft portion and the bottom marginal portion of the slide guide.

5 Claims, 2 Drawing Sheets

SOLENOID FOR ELECTROMAGNETIC VALVE

BACKGROUND OF THE INVENTION

1. Field of the Invention

This invention relates to a solenoid for an electromagnetic valve which is suitable for use in, for example, an electromagnetic proportional control valve.

2. Description of the Prior Art

In general, a solenoid for an electromagnetic valve comprises an exciting coil, an inner housing excited by the exciting coil, and a plunger made of a magnetic material slidably contained within the inner housing. Accordingly, in order to operate the plunger, it is definitely required to form a small space portion between the inner periphery of the inner housing and the outer periphery of the plunger.

However, it is difficult to adequately set the space portion. For example, if the space portion is made too large, the plunger tends to fall and rub the inner periphery of the inner housing thereby to produce a loss of electromagnetic force, while if the space portion is made too small, there is a possibility that the plunger becomes unable to operate due to dust, etc. which enter therein.

In view of the above, the above-mentioned space portion was heretofore properly set and, as means for holding the space portion, for example, the plunger was provided on both ends thereof with a guide rod of a small diameter projecting therefrom and the rods were slidably held by a bearing portion which was provided coaxial with the plunger. However, the guide rods and the bearing portions were required to be precisely machined. In addition, when these were to be mounted, they were required to be precisely located coaxial with respect to the coil. Accordingly, these problems have been required to be solved.

In recent times, in order to obtain a predetermined result, the said space is formed of a non-magnetic tubular body. However, since a pressure oil of high pressure is usually contained around the tubular body, it is impractical that the tubular body is made of a thin cylindrical member because of lack of strength thereof. As another example, Japanese patent early laid-open publication No. 50-43523 discloses a device in which the tubular body is formed of a thick cylindrical member in order to ensure the strength. In the above-described solenoid, the tubular body can stand the high pressure from the pressure oil because of its thick structure. However, since the plunger is directly slidably disposed within the magnetic portion which is located coaxial with the tubular body, loss of the electromagnetic force is significantly large and therefore this is not effective.

SUMMARY OF THE INVENTION

It is therefore a general object of the present invention to provide a solenoid for an electromagnetic valve which can solve the above problems and in which the plunger can be smoothly operated by effectively utilizing the electromagnetic force.

Another object of the present invention is to provide a solenoid for an electromagnetic valve in which a thin tubular slide guide having an end face or a bottom is disposed between the plunger and the inner housing so that a space between the plunger and the inner housing can be easily and properly set and the slide guide is prevented from being deformed.

A further object of the present invention is to provide a solenoid for an electromagnetic valve in which the opposite end faces of the plunger and the stopper are each provided with an attracting portion comprising a concave and a convex tapered surfaces. These attracting portions are provided at the marginal portions of the large diameter side thereof with a plain engaging surface and a retaining surface which are engagable with each other so that a high speed response of the plunger can be obtained when the coil is excited and demagnetized.

A still further object of the present invention is to provide a solenoid for an electromagnetic valve which can be manually operated in an emergency or the like.

In order to achieve the above objects, there is essentially provided a solenoid for an electromagnetic valve in which an exciting coil is contained between an outer housing and an inner housing, and a plunger is slidably contained inside the inner housing, the solenoid for an electromagnetic valve comprising a tubular slide guide having an end face or a bottom interposed between the inner housing and the plunger, a stopper fitted into an opening end of the slide guide and adapted to restrict the movement of the plunger, and a push rod able to engage with the plunger movably disposed at the bottom side of the slide guide in the axial direction.

The above and other objects, features, and advantages of the present invention will become more apparent from the following detailed description of the embodiment with reference to the accompanying drawings.

DETAILED DESCRIPTION OF THE PREFERRED EMBODIMENTS

Figure 1:
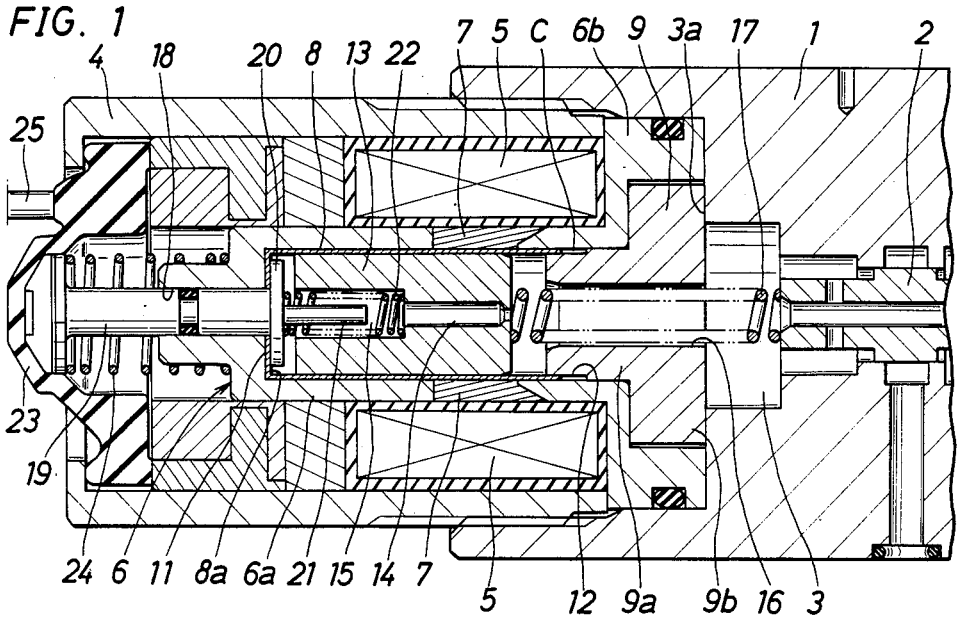
FIG. 1 is a sectional view showing one embodiment of the present invention.
Figure 2:
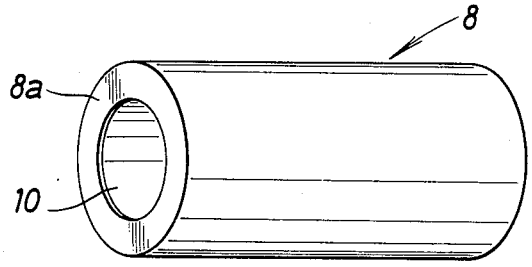
FIG. 2 is a perspective showing one example of a slide guide which is used in the present invention.
Figure 3:
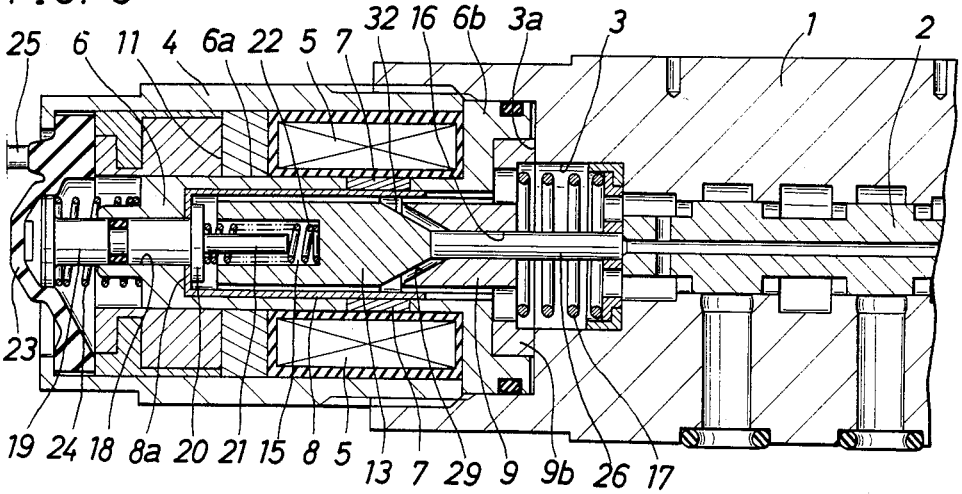
FIG. 3 is a sectional view showing another embodiment of the present invention.
Figure 4:
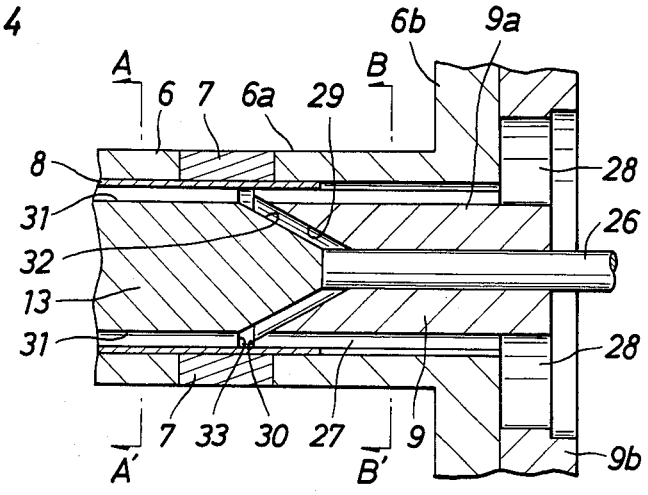
FIG. 4 is a sectional view showing an important portion of FIG. 3 but in an enlarged scale.
Figure 5:
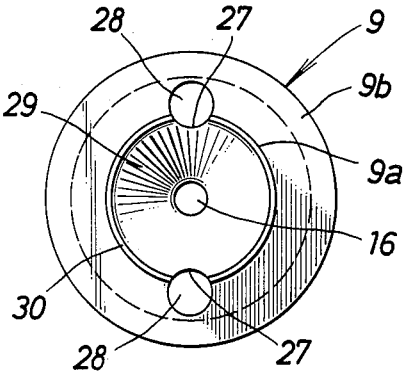
FIGS. 5 and 6 are front views showing the opposite end portions of the stopper and the plunger which are used in said another embodiment.
Figure 6:
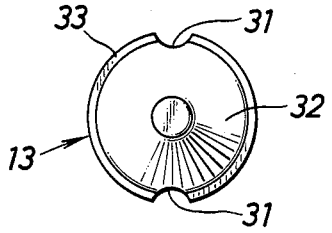
Figure 7:
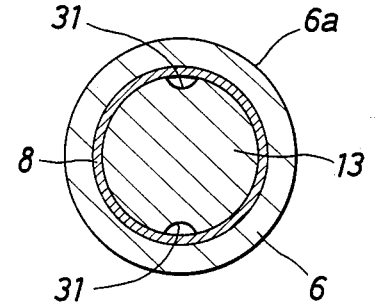
FIG. 7 is a sectional view taken along line A—A′ of FIG. 4.
Figure 8:
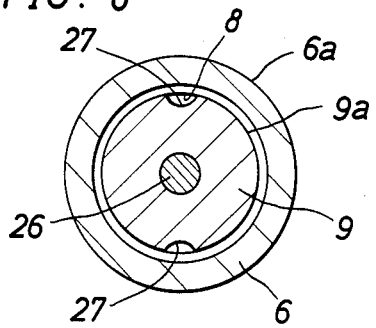
FIG. 8 is a sectional view taken along line B—B′ of FIG. 4.

One preferred embodiment of the present invention will be described with reference to the accompanying drawings, in which the present invention is applied to an electromagnetic proportional solenoid. In FIGS. 1 and 2, reference numeral 1 denotes a valve housing of a direction switching valve which slidably contains a spool 2 therein. The valve housing 1 is provided with an oil chamber 3 opened up at one end portion thereof. An outer housing 4 is secured to the inner periphery of the opening of the oil chamber 3.

The outer housing 4 is formed of a tubular cylindrical body. An exciting coil 5, which is contained in the outer housing 4, contains therein a hollow sleeve-shaped inner housing 6 made of a magnetic material. The inner housing 6 includes a generally straight tubular shaft sleeve portion **6*a* which is contained within the coil 5, and a flange portion 6*b*** which is integral with the shaft sleeve portion 6a which is contained on a stepped-portion 3a within the oil chamber 3. An annular non-magnetic portion 7 is situated at a position opposite to the coil 5 of the shaft sleeve portion 6a.

In this embodiment, the non-magnetic portion 7 forms part of the shaft sleeve portion 6a, and is constituted by a tubular non-magnetic material provided at one end thereof with a concave conical surface and integrally welded to the shaft sleeve portion 6a. Alternatively, this non-magnetic portion 7 may be formed of a space.

The inner housing contains 6 therein a tubular slide guide 8 having an end face or a bottom, and a stopper 9 for restricting the movement of a plunger which will be described hereinafter. The slide guide 8 is formed of a thin non-magnetic material. The slide guide 8 is provided in the bottom end thereof with a communicating hole 10 as shown in FIG. 2. The bottom marginal portion 8a of the slide guide 8 is contained on a stepped portion 11 within the shaft sleeve portion 6a, while the opening end thereof is positioned on the periphery of a stationary shaft portion 9a of the stopper 9.

The stopper 9 has a stationary shaft portion 9a which is intimately contacted and contained within the shaft sleeve portion 6a of the inner housing 6. The front end of the shaft portion 9a is slightly reduced in diameter compared with the basic portion thereof. The front end of the reduced diameter portion 12 is intimately contacted and inserted into the opening end of the slide guide 8. Between the basic end of the reduced diameter portion 12 and the opening end, a small space C is provided in order to permit the slide guide 8 to be deformed in the axial direction. The stationary shaft portion 9a is provided at one end thereof with a flange portion 9b which is contained within the flange portion 6b, the end face of the flange portion 9b being contained on the stepped portion 3a.

A plunger 13 is slidably contained within the slide guide 8. The plunger 13 is formed of a cylindrical magnetic material and is provided at opposite ends thereof with small and large holes 14 and 15 communicating with each other. The small hole 14 is communicated with the oil chamber 3 through a through hole 16 which is formed in the stopper 9. And, a return spring 17 is interposed between the end faces of the plunger 13 and the spool 2 through the hole 16. The plunger 13 is normally urged towards outside by the spring 17.

On the other hand, the external end portion of the shaft sleeve portion 6a of the inner housing 6 is formed with a guide hole 18 which communicates with the interior of the shaft sleeve portion 6a. A push rod 19 for manual operation is slidably contained within the hole 18 in the axial direction. The push rod 19 located in the inner housing 6 is provided with a flange-shaped engaging piece 20 which is engagable with the end face of the plunger 13. The engaging piece 20 is provided with a guide pin 21 projecting from the center thereof. The guide pin 21 projects into the concave hole 15. Between the engaging piece 20 and the bottom portion of the concave hole 15, a plunger spring 22 is interposed. The plunger 13 is urged towards the stopper 9 by the spring 22.

In the figures, reference 23 denotes a rubber cap attached to the front end of the push rod 19. Between the inner surface of the cap 23 and the end face of the shaft sleeve portion 6a, a spring 24 is interposed. The push rod 19 is urged towards outside by the spring 24, so that the engaging piece 20 is normally pushed against the marginal portion 8a of the opening on the stepped portion 11. Numeral 25 denotes a wiring tube which is connected at one end with the external end portion of the cap 23. A lead wire communicating with the exciting coil 5 is contained in the wiring tube 25.

FIGS. 3 through 8 illustrate another embodiment of the present invention, in which the present invention is applied to an on-off type electromagnetic valve. Component parts corresponding to those of the preceding embodiment are designated by identical reference numerals. In this embodiment, a non-magnetic portion 7 which is integral with an inner housing 6 is formed of a tubular body having both plain end faces. A rod 26 instead of the return spring 17 is slidably fitted in a through hole 16 formed in a stopper 9. This is interposed between the end faces of a spool 2 and a plunger 13.

The peripheries of a stationary shaft portion 9a of the stopper 9 and a flange portion 6b are formed with oil grooves 27, 27 and communicating holes 28, 28 which communicate with each other. The oil grooves 27, 27 and the communicating holes 28, 28 communicate with an oil chamber 3. The front end of the stationary shaft portion 9a is formed into a concave-shaped tapered surface in order to increase the attracting area thereof. The marginal portion of a large diameter portion of the attracting portion 29 is formed with a plain retaining surface 30.

On the other hand, the plunger 13 is not provided with the small hole 14 but it has formed in the periphery thereof oil grooves 31, 31 in the axial direction to flow operating oil to enhance the lubrication between the plunger 13 and the slide guide 8. The end face of the plunger 13 opposite to the stopper 9 is formed into a convex-shaped tapered surface. The marginal portion of the large diameter portion of the attracting portion 32 is formed with a plain retaining surface 33 so that it can be abutted against the retaining surface 30.

Namely, in this embodiment, the attracting areas of the attracting portions 29 and 32 are made large to obtain an increased attracting force when the exciting coil 5 is excited, so that high speed response of the plunger 13 is obtained and sureness of the operation thereof is ensured. On the other hand, the retaining surface 30 and the retaining surface 33 as abutting surfaces are reduced in area to enhance the attenuation of the remaining magnet when the coil 5 is demagnetized, so that the plunger 13 can be rapidly returned to its original position.

With the above-described constitution of the solenoid, in the case the plunger 13 is to be mounted therein, for example, a slide guide 8 is slidably put in the shaft sleeve portion 6a of the inner housing 6 with the bottom marginal portion 8a facing a stepped portion 11. After a push rod 19 has been inserted from inside of the guide 8 into a communicating hole 10, the plunger 13 containing a plunger spring 22 therein is inserted into a concave hole 15 from the opening end of the slide guide 8.

Between the outer periphery of the plunger 13 and the inner periphery of the shaft sleeve portion 6a, a space corresponding to the thickness of the slide guide 8 made of a non-magnetic material is formed evenly and surely. Therefore, the space can be easily and surely set compared with the conventional procedure for achieving the same purpose. Furthermore, by mounting the plunger 13, the coaxial arrangement thereof with respect to the exciting coil 5 is necessarily attained. Accordingly, since no special working is required for the plunger 13 and since no parts for exclusive use are required, labor for machining and the number of the component parts can be reduced compared with the conventional devices. Thus, the mounting work can be performed very easily and rapidly.

The operation of the above-described solenoid will be further described with reference to the embodiment illustrated in FIGS. 1 and 2. The slide guide 8 is intimately contacted and contained in the inner periphery of the inner housing 6. The bottom marginal portion 8*a* at the bottom side of the slide guide is contained on the stepped portion 11 within the inner housing 6. An engaging piece 20, which is integral with the push rod 19, is normally pushed against the bottom marginal portion 8*a* thereby to maintain the slide guide 8 in a predetermined position and to prevent the slide guide 8 from being deformed.

On the other hand, the front end of the reduced diameter portion 12 of the stopper 9 is intimately contacted and fitted into the opening end of the slide guide 8. Accordingly, its deformation under pressure towards inside and outside the opening end can be prevented. In addition, since the space C is provided between the opening end and the basic portion of the small diameter portion 12 as shown in FIG. 1, the slide guide 8 is prevented from being deformed in the axial direction.

In this way, the slide guide 8 is prevented at the bottom end and the opening end thereof from being deformed under pressure. In addition, since a large part of the periphery of the slide guide 8 is held by the inner housing 6 and the plunger 13 so that the slide guide 8 will not be deformed, even if the slide guide 8 is formed of a thin material, there is no worry in respect of pressure deformation nor strength. Thus, an even and stable sliding surface can be obtained with respect to the plunger 13.

In addition, the provision of the slide guide 8 between the inner housing 6 and the plunger 13 eliminates the trouble involved in the conventional devices for setting the space, thereby to obtain easy manufacturing.

On the other hand, both ends of the plunger 13, which is contained in the slide guide 8, are provided with a return spring 17 and a plunger spring 22. The plunger 13 is held stationary in a position where the springs 17 and 22 are balanced. One end of the plunger spring 22 is abutted against the end face of the spool 2 so that the displacement of the plunger 13 can be transmitted to the spool 2.

When the exciting coil 5 is excited under the above-described circumstance, a magnetic circuit is formed between the coil 5 and the plunger 13. As a result, the plunger 13 is attracted and moved rightwards in FIG. 1 against the return spring 17.

In this case, the plunger 13 moves along the inner periphery of the slide guide 8. However, since the slide guide 8 is formed of a non-magnetic material, the plunger 13 is not attractedly attached to the inner periphery of the guide 8. Moreover, since the guide 8 is intimately contacted and contained within the inner housing 6 and is disposed coaxial with the housing 6, the plunger 13 itself within the slide guide 8 is aligned and moves on the coaxis of the guide 8 smoothly and stably.

In this way, when the plunger 13 moves in the direction as mentioned, the return spring 17 is biased to that extent and transmits the restoring force to the spool 2. As a result, the spool 2 is pushed and moved in said direction against a reset spring (not shown) in order to open and close a predetermined port to switch the flow of pressure oil.

On the other hand, in the case, for example, the exciting coil 5 is out of order and thus unable to operate the solenoid can be manually operated. To achieve the foregoing purpose, the cap 23 is pressed rightwards in FIG. 1 in this case and the push rod 19, which is integral with the cap 23, is pushed in the same direction.

As a result, the push rod 19 moves in the axial direction against the spring 24. As a result, the engaging piece 20 provided on the rod 19 is abutted against the end face of the plunger 13 and pushes the plunger 13 to move in the same direction. As a result, the plunger 13 is moved an amount corresponding to the displacement of the push rod 19 to control the operation of the direction switching valve in the same procedure as described. Even in this manual operation, since the slide guide 8 and the plunger 13 maintain the afore-described relation, a smooth and stable operation of the plunger 13 can be obtained.

As described in the foregoing, a solenoid for an electromagnetic valve of the present invention comprises an exciting coil, a tubular hollow inner housing with a shaft sleeve portion thereof disposed within the coil, a tubular slide guide having an end face or a bottom made of a non-magnetic material which is contained within the housing, a stopper with a stationary shaft portion fitted in an opening end of the slide guide, and a plunger slidably contained in the interior of the slide guide which is defined by the end face of the shaft portion and the bottom marginal portion of the slide guide. Accordingly, the plunger can be smoothly operated by effectively utilizing the electromagnetic force. In addition, by virtue of a provision of the slide guide, the space between the plunger and the inner housing can be set very easily and surely. Thus, exclusive parts and related parts, which were required in the conventional devices, are no more required. In this way, the present invention can solve the problems involved in the related prior art all at once.

Furthermore, according to the present invention, the front end of the stationary shaft portion is formed with a reduced diameter portion, and a space is defined by the reduced diameter portion, the inner periphery of the inner housing, and the marginal portion of the opening of the slide guide. Accordingly, the slide guide can be prevented from being deformed, and can be made thin and compact. In addition, any anxiety in respect of its strength can be wiped out.

Furthermore, according to the present invention, the opposite end faces of the stationary shaft portion and the plunger are each provided with a tapered surface-shaped attracting portion for attracting each other, and these attracting portions are formed at the large diameter portion side marginal portions with a plain retaining surface and a plain engaging surface which are able to abut with each other, so that when the coil is excited, the attracting performance of the plunger will be enhanced, and so that when the coil is demagnetized, the remaining magnetism will be rapidly attenuated. Thus, quick response of the plunger can be obtained.

Moreover, according to the present invention, the stationary shaft portion and the plunger are each formed in the peripheries thereof with an oil groove communicating with an oil source in order to enhance the lubrication of the plunger. Accordingly, the quick response can be further improved. In addition, according to the present invention, a push rod is slidably provided to the interior of the inner housing opposite to the stopper, and the front end of the rod is provided with an engaging piece which is engagable with the end face of the plunger. Accordingly, it can be operated manually in an emergency or the like.

What is claimed is:

1. A solenoid for an electromagnetic valve comprising an exciting coil, a tubular hollow inner housing with a shaft sleeve portion thereof disposed within said coil, a tubular slide guide having a bottom and made of a non-magnetic material which is contained within said housing, a stopper with a stationary shaft portion fitted in an opened end of said slide guide, and a plunger, which is driven by the electromagnetic force of said coil, slidably contained within said slide guide between the end face of said shaft portion and the bottom of said slide guide.

2. A solenoid for an electromagnetic valve as claimed in claim 1, wherein said stationary shaft portion is formed at the front end thereof with a reduced diameter portion, and a space is defined by said reduced diameter portion, the inner periphery of said inner housing, and the open end of said slide guide.

3. A solenoid for an electromagnetic valve as claimed in claim 1, wherein the opposed end faces of said stationary shaft portion and said plunger are each provided with a tapered surface-shaped attracting portion engagable with each other, and these attracting portions are provided at the large diameter portions with a plain retaining surface and a plain engaging surface engagable with each other.

4. A solenoid for an electromagnetic valve as claimed in claim 3, wherein said stationary shaft portion and said plunger are each formed in the peripheries with an oil groove communicating with an oil source.

5. A solenoid for an electromagnetic valve as claimed in any one of claims 1 through 4, wherein a push rod is slidably provided in the interior of said inner housing opposite to said stopper, and the front end of said push rod is provided with an engaging piece which is engagable with the end face of said plunger.

* * * * *